US005855219A

United States Patent [19]

Spencer

[11] Patent Number: 5,855,219

[45] Date of Patent: Jan. 5, 1999

[54] BOTTLE WASHING APPARATUS

[76] Inventor: Michael P. Spencer, 18065 Sundowner Wy, Canyon Country, Calif. 91351

[21] Appl. No.: 771,260

[22] Filed: Dec. 20, 1996

[51] Int. Cl.[6] ..... B08B 3/02

[52] U.S. Cl. ..... 134/167 R; 134/176; 134/179; 134/198; 239/251; 239/262

[58] Field of Search ..... 134/166 R, 166 C, 134/167 R, 167 C, 179, 176, 198, 177, 180; 239/265.11, 251, 262

[56] References Cited

U.S. PATENT DOCUMENTS

| | | | |
|---|---|---|---|
| 383,964 | 6/1888 | Mackintosh | 134/167 R |
| 2,526,265 | 10/1950 | Nulph | 134/198 |
| 2,646,244 | 7/1953 | Sohn | 134/169 R |
| 2,691,380 | 10/1954 | Bartos | 134/180 |
| 2,697,341 | 12/1954 | Thomas | 134/179 |
| 3,961,984 | 6/1976 | Torressen | 134/179 |
| 4,184,775 | 1/1980 | Akizawa | 134/180 |
| 4,806,172 | 2/1989 | Adaci et al. | 239/550 |
| 4,930,531 | 6/1990 | Ballu | 134/167 R |
| 5,024,382 | 6/1991 | Shook et al. | 239/251 |
| 5,573,187 | 11/1996 | Proctor | 134/167 R |

FOREIGN PATENT DOCUMENTS

| | | | |
|---|---|---|---|
| 217057 | 2/1957 | Australia | 239/251 |

*Primary Examiner*—Frankie L. Stinson
*Attorney, Agent, or Firm*—Gerald L. Price

[57] ABSTRACT

A bottle washing apparatus for effectively washing the inside of bottles that are coated with solid particulate residue. The apparatus includes a fixed portion that connects to a conventional faucet and an elongated closed ended hollow shaft that is provided with a plurality of small orifices. A second closed ended hollow shaft concentrically overlies the first shaft and is rotationally affixed thereto. The second shaft is provided with a plurality of smaller orifices that are tangential with the circumference of the shaft so that when water pressure is applied to the fixed portion, water passes through the orifices in the first shaft and then through the tangential orifices of the second shaft causing the second shaft to rotate at a high rate of speed while discharging the water in needle-like streams under high pressure. When the rotating shaft is placed into a small mouth bottle with deposits of reside on the inside surface, such as a baby formula residue, the combination of the high pressure discharge and high speed rotation provide a highly efficient and effective washing action.

7 Claims, 1 Drawing Sheet

FIG. 1
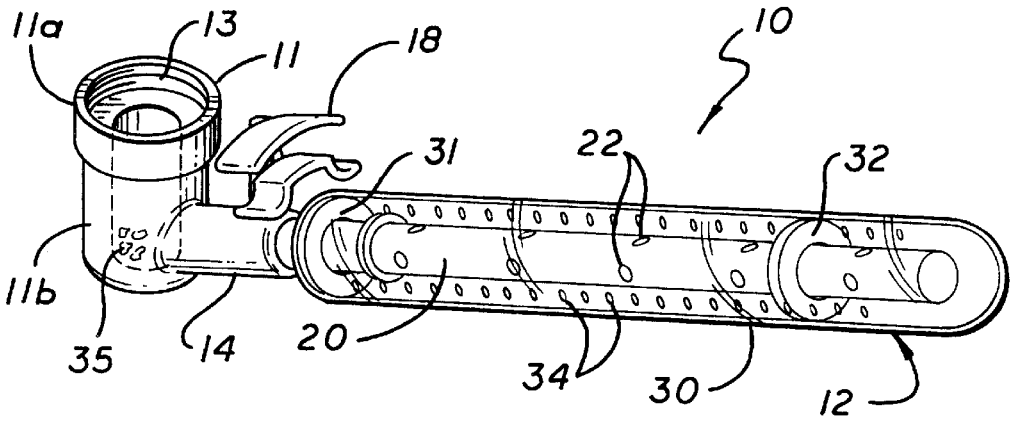
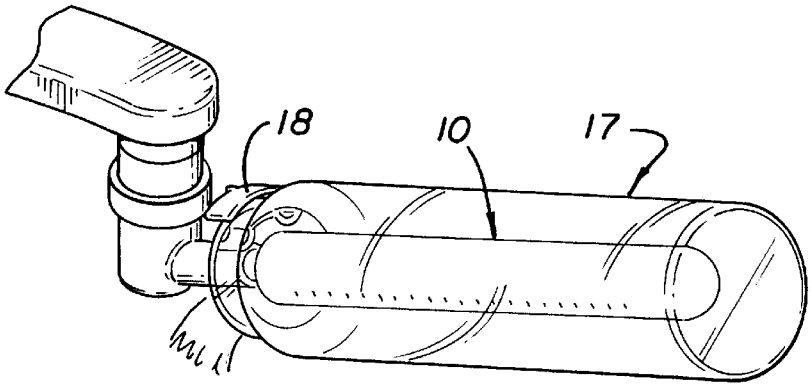
FIG. 2
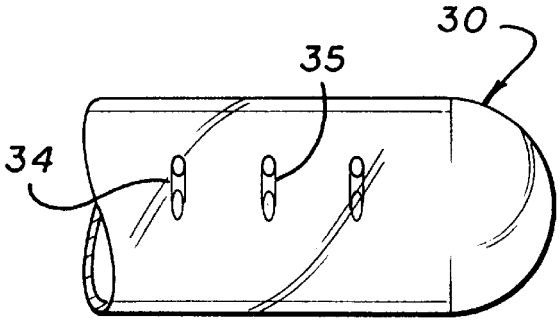
FIG. 3

BOTTLE WASHING APPARATUS

BACKGROUND OF THE INVENTION

The present invention relates generally to washing bottles and more particularly to a new and improved bottle washing apparatus for washing the interior of small mouth bottles such as baby bottles and test tubes.

Cleaning the interior of small mouth bottles such as baby bottles and test tubes have presented problems for many years that to date have not been effectively solved for home and small laboratories that do not have access to commercial equipment. While commercial bottling plants have automatic machines that insert spray heads, rotating brushes and super heated water and detergent under pressure into bottles, as described, for example in U.S. Pat. No. 1,940,615 to Webster, this procedure cannot be duplicated in a home kitchen for baby bottles or in a small laboratory for test tubes. Instead, a number of methods of washing bottles have been used. The most common method is the utilization of a bottle brush. While a bottle brush when combined with soap and hot water will clean the interior of a bottle with dried residue or the like adhering to the interior surfaces, it requires considerable effort and a brush always presents the possibility of introducing bacteria and germs into a bottle and a separate and through rinsing operation has to be manually performed after the brushing. There have also been several patents in the prior art that address the problem of bottle cleaning. U.S. Pat. Nos. 466,680 to Harris and Goodsell, 1,893,498 to Herzog, and 1,577,236 to Huss, all disclose rigid or flexible shafts that are inserted into a bottle and water pressure is discharged through the shaft to wash the interior of the bottle.

While the aforestated devices provide washing action, when the solids in the liquid previously held by the bottle dry in the bottle and become encrusted on the interior surface the bottle, the washing action afforded by these devices is generally ineffective or the time required to loosen and remove such material is excessive.

SUMMARY OF THE INVENTION

It is the general aim of the present invention to provide a new and improved bottle washing apparatus that is economical to purchase, simple to use and which provides superior washing and rinsing action for dislodging solid particulate from the interior surfaces of the bottle.

It is another object of the invention to provide a bottle washing apparatus which applies water under pressure in a rotational pattern which was heretofore only available with large and expensive commercial machinery.

BRIEF DESCRIPTION OF THE DRAWING

Additional objects and advantages of the invention will appear from the following description taken in conjunction with the accompanying drawings in which:

FIG. 1 is a perspective view of an exemplary bottle washer embodying the features of the present invention;

FIG. 2 is a perspective view of an exemplary bottle washer shown affixed to a conventional sink faucet and in operation cleaning a baby bottle; and FIG. 3 is a sectional view of the outer rotating cylinder of the washer shown in FIG. 1 showing the detail of the orifices that produce the rotation and pressure washing.

While the present invention is susceptible of various modifications and alternative constructions, illustrative embodiments are shown in the drawings and will herein be described in detail. It should be understood however, that it is not to be intended to limit the invention to the particular forms disclosed, but, on the contrary, the intention is to cover all modifications, equivalents, and alternative construction falling within the spirit and scope of the invention as expressed in the appended claims.

DESCRIPTION OF THE PREFERRED EMBODIMENT

Referring now to FIG. 1, an exemplary bottle washing apparatus generally indicated at 10 is illustrated which includes an adapter member 11, a stationary spray shaft 20, and an outer rotating spray shaft 30. In order to mount the bottle washing apparatus of the instant invention for use and to provide a source of water, provision is made to attach the adapter member 11 to a conventional sink faucet. As shown in FIG. 1, this is accomplished by providing the upper end of the adapter member 11 with a screw thread 13 that is sized to attach to the threads utilized on most conventional kitchen faucets for attaching flow aerators of the like. It is pointed out however that the means of attachment, other than providing a stable mounting and source of water pressure is not critical to the invention and other well known attachment means could also utilized such as a two part snap on adapter commonly used on air and water applications or even the well known flexible slip on adapter of the type shown in U.S. Pat. No. 1,893,498 to Herzog.

The primary object of the present invention is to provide high pressure, high speed rotational washing action, to the internal surfaces of a small mouth bottle. To accomplish this, the exemplary apparatus 10 utilizes a cylindrical assembly 12 that is sized to be inserted into a conventional small mouth bottle such as a baby bottle. This cylindrical assembly comprises a stationary hollow cylinder 20 which has a closed top and a bottom that is secured to a rigid tube or pipe 14 which in turn is secured to the lower end of the adapter member 11. The means to secure the aforestated components can be any conventional means including corresponding threads or adhesive compatible with the materials utilized. In production, it is contemplated that all of the components of the within apparatus will be fabricated out of suitable plastic to provide economy in production and for sanitary considerations. In the event that all or part of the components of the exemplary apparatus are connected and secured by means of corresponding threads, it is contemplated that such mating threads will be tapered to facilitate moldmaking and to provide leak free operation under water pressure.

As will be hereinafter described in detail, the stationary spray shaft 20 is provided with a plurality of orifices about its circumference to supply uniformly distributed water pressure to the outer rotating shaft 30. In the exemplary apparatus 10, orifices 22 of about one eight of an inch in diameter are provided in evenly spaced groups of four about the circumference of the stationary spray shaft 20 and each group is spaced along the length of the stationary spray shaft about an inch apart.

The outer rotating shaft 30 which applies the high pressure water washing action to the interior of a bottle as diagrammatically depicted in FIG. 2, is mounted concentrically and rotationally over the stationary shaft 20. To provide a freely rotating action, the outer rotating shaft 30 is provided with a pair of bearings 31 and 32 which are affixed to the interior surface of rotating shaft 30 and are sized to provide a loose slip fit over stationary shaft 20. The bearings can be fabricated out of any material which provides low resistance and compatibility with water. Materials including Teflon, nylon and delrin have all been found to provide these desired attributes.

In order to maintain the outer shaft 30 on the inner stationary shaft 20 and from coming off during operation, a ring or protrusion 33 having a diameter larger than the shaft 20 is provided on the shaft 20 between the two bearings 31 and 32 and proximate to bearing 31 which is at the open end of the shaft 30.

In order to provide high speed rotation and high pressure washing action which are necessary to accomplish the objects of the present invention, the outer rotating shaft 30 is provided with a plurality of small orifices 34. These orifices are about one thirty second of an inch in diameter and provided in sets of two equally spaced about the circumference of the shaft and each set is spaced about three eights of an inch apart. In order to achieve the high speed rotation of the outer shaft the orifices 34 are tangential with the outer circumference of the outer shaft 34. As shown in FIG. 3, each orifice 34 includes a groove 35 in the inner wall of the outer shaft 34 which is also tangential to the circumference of the shaft whereby water under pressure is directed through the orifices 34 in a tangential flow which in turn imparts substantial speed to the rotation of the shaft 30.

In operation, the bottle washing apparatus is first attached to a kitchen sink faucet utilizing the adapter member 11. While a dirty bottle can be manually slipped over the cylinder assembly 12 and held in place during the washing operation, a bottle retaining bracket 18 is provided on the rigid tube 14 to engage the rim of a bottle and hold it in place during the washing operation as depicted in FIG. 2.

Once a bottle to be washed is in place, the hot water valve on the faucet is opened and the water will flow under pressure through the adapter 11 into the stationary shaft 20 and into the outer rotating shaft 30 through orifices 22. Once the hot water enters the outer rotating shaft 30 in a uniformly distributed pattern due to the orifice arrangement, the hot water then exits the plurality of small tangential orifices 34 causing the shaft to rotate at high speed while discharging hot water under pressure through each orifice. This action has the effect of loosening material such as formula and milk that has dried and adhered to the inside surface of a bottle. The removed particulate is discharged from the bottom of the bottle along with the expended water. In order to provide supplemental chemical cleaning and disinfecting to the washing, provision is made to remove the upper portion 11*a* of the adapter member 11 so that detergent and disinfectant capsules, granules or the like can be placed in the lower portion 11*b* of the adaptor member 11 as shown in FIG. 1. Accordingly, when hot water is first applied to the apparatus, it will begin to dissolve such chemicals so that the initial bottle washing will be supplemented with same. It is contemplated that inert color dyes can be blended in these chemicals so that the user will be able to observe when the chemical supplemented portion of the bottle washing is completed.

What I claim is:

1. An apparatus for washing small mouth bottles comprising an adaptor member having means for attachment to a conventional kitchen sink faucet and an elongated cylindrical means rotationally mounted thereon whereby when said cylindrical means is inserted into a bottle and the kitchen sink faucet is opened, water will exit said cylindrical means in a direction tangential to the circumference of said cylindrical means causing the external portion of said cylindrical means to rotate at a high rate of speed thereby distributing the water at high pressure throughout the interior of such bottle and wherein said cylindrical means comprises a first elongated cylinder fixedly mounted to said adaptor means and a second elongated cylinder concentrically and rotationally mounted concentric with said first elongated cylinder, said first cylinder having a plurality of orifices along its surface and said second elongated closed end cylinder having a plurality of orifices along its surface.

2. The apparatus of claim 1, wherein the plurality of said orifices in said second elongated cylinder are generally tangential to the circumference thereof.

3. The apparatus of claim 2, wherein bearing means are positioned between said first and second cylinders whereby said second elongated cylinder will rotate freely and retaining means are provided to prevent said second elongated cylinder from being separated from said first cylinder.

4. The apparatus of claim 3, wherein said adaptor means further includes bottle retaining means to engage and position a small mouth bottle over said second elongated cylinder.

5. An apparatus for washing small mouth bottles comprising a tubular adaptor having a closed end and an open end, a threaded coupling mounted around said open end to secure said tubular adapter to the threaded outlet of a water faucet, a first cylinder rigidly secured to said tubular adapter between said closed and open ends to extend in fluid communication therewith, a plurality of orifices distributed over the surface of said first cylinder, a second cylinder having a closed end and an open end concentrically mounted over said first cylinder, spaced bearing means positioned between said first and second cylinders permitting rotation of said second cylinder with respect to said first cylinder, and a plurality of tangential orifices distributed over the surface of said second cylinder whereby when a bottle to be washed is inserted over said second cylinder and the water faucet turned on, fluid under pressure discharges through said tangential orifices causing rotation of said second cylinder to distribute the fluid at high pressure throughout the interior of the bottle.

6. The apparatus of claim 5 including retaining means secured to said first cylinder between said spaced bearings to prevent said second cylinder from being separated from said first cylinder.

7. The apparatus of claim 5 including bottle retaining means to engage and position a small mouth bottle over said second cylinder.

* * * * *